United States Patent [19]

Ganther

[11] Patent Number: 4,464,867

[45] Date of Patent: Aug. 14, 1984

[54] RADIALLY ADJUSTABLE LAP

[75] Inventor: Forrest E. Ganther, Muskogee, Okla.

[73] Assignee: Coburn Optical Industries, Inc., Muskogee, Okla.

[21] Appl. No.: 337,894

[22] Filed: Jan. 7, 1982

Related U.S. Application Data

[63] Continuation of Ser. No. 60,711, Jul. 26, 1979, abandoned.

[51] Int. Cl.[3] ..... E06B 7/14

[52] U.S. Cl. ..... 51/209 R; 51/241 A; 51/284 R

[58] Field of Search ..... 51/204, 209 R, 241 VS, 51/330, 331, 241 A, 284 R

[56] References Cited

U.S. PATENT DOCUMENTS 2,168,753 8/1939 Smith ..... 51/204 X

*Primary Examiner*—E. R. Kazenske
*Assistant Examiner*—Douglas D. Watts
*Attorney, Agent, or Firm*—John J. Byrne; Bradford E. Kile; Kevin M. O'Brien

[57] ABSTRACT

Disclosed is a convex lap comprising a plurality of polishing elements which are radially adjustable to ensure that the effective radius of the polishing surface remains constant as the polishing elements are worn down. A means is provided to radially set individual and independent clusters to enhance polishing of certain compound curves.

1 Claim, 6 Drawing Figures

RADIALLY ADJUSTABLE LAP

This is a continuation of application Ser. No. 60,711, filed July 26, 1979 now abandoned.

TECHNICAL FIELD

This invention relates to laps such as are used to grind, polish, and fine optical elements. More particularly, it relates to convex laps which are used to grind, polish, and fine toric lenses.

BACKGROUND OF THE INVENTION

Unlike machines which fine spherical lenses, in machines used to grind, polish, and fine toric lenses, the lap is not rotated. It is given an irregular "break-up" motion the purpose of which is to constantly bring fresh points on the polishing elements into contact with each point on the work piece, thereby ensuring that the work piece will have a totally smooth surface.

Conventional laps used to grind, polish, and fine toric lenses comprise a body, means for translating the body in a "breakup" pattern during polishing of the work pieces, and a plurality of grinding, polishing, or fining elements (hereinafter referred to generically as "polishing elements") mounted on the working surface of the body such that the working surface of the polishing elements define a convex polishing surface. The body is typically made of aluminum, the means for translating the body is typically a rectangular stub shaft sized to be gripped by appropriate means on the grinding, polishing, or fining machine, and the polishing elements are typically aluminum pads to the working surfaces of which a plurality of diamond pellets are secured. The pads may be removable so that they may be individually replaced when the diamond pellets on each pad have worn to an unacceptable degree.

Conventional laps suffer from a serious flaw. The polishing elements are mounted in fixed positions on the bodies of the laps. As shown in schematic (and highly exaggerated) form in FIG. 1, the effective diameter of the working surface of the lap is the distance D from the radially outer point of each of the radially outermost diamond pellets to the radially outer point of the diametrically opposite outermost diamond pellet. However, as the diamond pellets wear down, the distance D decreases to the distance D'. (Of course, in actual practice both the wear on the pellets and the difference between D and D' are on the order of a few millimeters.) The "breakup" motion of the lap is designed to ensure that each point on the workpiece is traversed by a point on the polishing elements the same number of times, but the absence of polishing surface between the worn-down diameter D' and the original diameter D means that some points on the workpieces will not be traversed as often as others. This in turn causes imperfections in the finished product.

OBJECTS AND ADVANTAGES OF THE INVENTION

It is, therefore, a general object of the invention to provide a lap which will obviate or minimize problems of the type previously described.

It is a particular object of the invention to provide such a lap which will be inexpensive to manufacture, sturdy, simple to operate, and not given to mechanical malfunctionings.

The main advantage of using the adjustable lap is to position the grinding/polishing elements in a unique pattern for a given combination of sphere and cylinder powers. Of course, the radius cannot be maintained constant, and the unit must be retrued when wear occurs. However, the adjustable feature permits or enhances the grinding/polishing operation for each unique combination of curves, and the optimum position(s) cannot be readily ascertained. Thus, by having the means for moving the clusters to new positions and retruing, maximum benefits are derived without machining a new set of laps.

Other objects and advantages of the present invention will become apparent from the following detailed description of a preferred embodiment thereof taken in conjunction with the accompanying drawings.

SUMMARY OF THE INVENTION

The invention is a non-planar lap comprising a plurality of polishing elements which are radially adjustable to ensure that the effective radius of the polishing surface remains constant as the polishing elements are worn down. A means is provided to radially set individual and independent clusters to enhance polishing of certain compound curves.

DETAILED DESCRIPTION OF THE PRESENTLY PREFERRED EMBODIMENT

Figure 2:
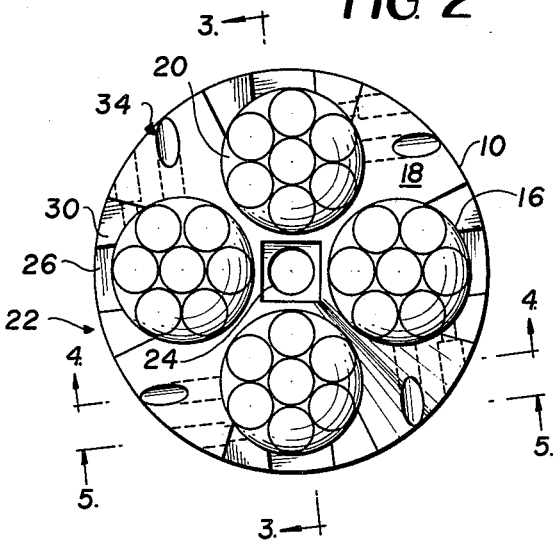
FIG. 2 is a plan view of the presently preferred embodiment of the subject invention.
Figure 6:
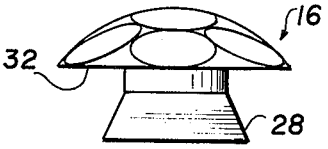
FIG. 6 is a side view of one of the polishing elements.
Figure 1:
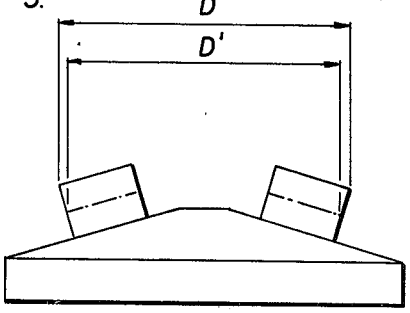
FIG. 1 PRIOR ART
FIG. 1 is a schematic side view used to illustrate the problem in the prior art that the subject invention is intended to obviate or minimize.
Figure 3:
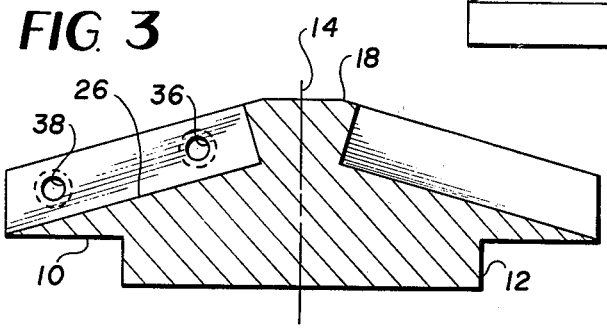
FIG. 3 is a view along the line 3—3 in FIG. 2 with the polishing elements removed.

The lap shown in FIGS. 2 through 5 comprises a body 10 with a central axis 14, a rectangular stub shaft 12 used to translate the lap in "breakup" motion during grinding, polishing, or fining of dome-shaped workpieces, a plurality of radially positioned polishing elements 16 (shown in FIGS. 2 and 6) mounted on the working surface 18 of the body 10 such that the working surfaces 20 of the polishing elements 16 define a convex surface for polishing work pieces, and means 22 (described in detail hereinafter) for radially adjusting the positions of at least some of the polishing elements 16 to ensure that the effective radius of the polishing surface remains constant as the polishing elements are worn down. Centrally positioned on the working surface 18 of the body 10 in FIG. 2 is an additional polishing element 24, but since it may be mounted by conventional techniques and is not part of the present invention, it has been omitted from FIGS. 3 and 5.

The illustrated lap is convex, being generally of the type which is used to grind, polish, or fine toric lenses. However, it is to be understood that the subject invention is generally applicable to any non-planar lap, whether used for optical or other purposes. In particular, a lap according to the subject invention can also be used to grind, polish, or fine spherical surfaces.

In the illustrated embodiment, the means 22 comprises a plurality of generally radial grooves 26 formed in the working surface 18 of the body 10 and a dove-tail mount 28 carried by each of the radially adjustable polishing elements 16. The dove-tail mounts 28 are sized and positioned to fit slidably in the grooves 26, so that the radial position of each of the polishing elements 16 can be continuously varied. Preferably, but not necessarily, flats 30 (best seen in FIG. 2) are provided on the working surface 18 adjacent the grooves 26 in position to slidably receive the undersides 32 of the polishing elements 16.

Figure 4:
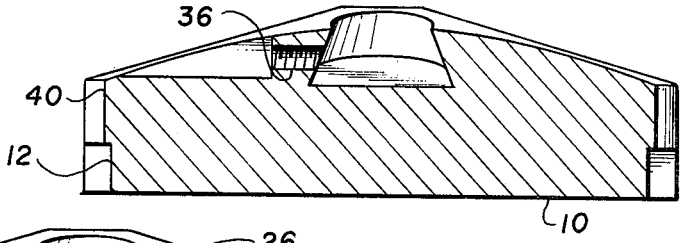
FIG. 4 is a view on a larger scale along the line 4—4 in FIG. 2 with the polishing elements removed.
Figure 5:
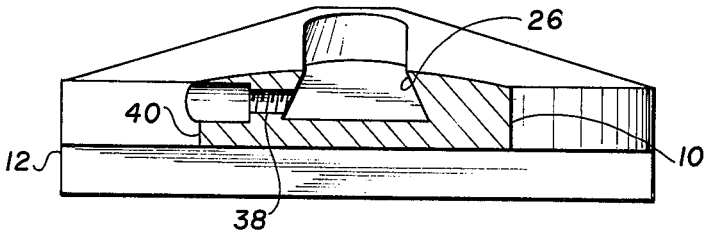
FIG. 5 is a view on a larger scale along the line 5—5 in FIG. 2 with the polishing elements removed.

Each polishing element 16 can be selectively fixed in selected radial positions in the associated groove 26 by means 34 which, in the illustrated embodiment, comprise set screw threaded through holes in the body 10. In the illustrated embodiment two set screws are provided for each polishing element 16. One set screw is threaded in a hole 36 (one of which is shown in FIG. 4) which opens onto the working surface 18 of the body 10. The other set screw is threaded in a hole 38 (one of which is shown in FIG. 5) which opens onto the radial periphery 40 of the body 10 above the rectangular stub shaft 12.

It should be noted that, while the grooves 26 should be at least generally radial, they need not be strictly radial. In fact, having the grooves 26 deviate somewhat from being strictly radial, as shown, may even enhance the operation on some combinations of spherical and cylindrical powers.

It should also be noted that, after each polishing element 16 has been shifted to a new position, its diamond surfaces should be retrued in order to maintain the integrity of the appropriate curves.

ADVANTAGES OF THE SUBJECT INVENTION

From the foregoing description of a radially adjustable lap in accordance with the preferred embodiment of the invention, those skilled in the art will recognize several advantages which singularly distinguish the subject invention from previously known laps. Some of those advantages are set forth below. However, while the following list of advantages is believed to be both accurate and representative, it does not purport to be exhaustive.

A particular advantage of the subject invention is that it permits the radial position of the polishing elements to be adjusted to compensate for wear, thereby ensuring that each point on the workpiece is traversed by a point on the polishing element the same number of times.

A further advantage of the subject invention is that it is inexpensive to manufacture, sturdy, simple to operate, and not given to mechanical malfunctionings.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

I claim:

1. A lap for grinding, polishing or fining a toric lens surface comprising:

a body having a convex surface containing a plurality of radial grooves formed in the upper surface thereof;

a plurality of polishing elements;

mounting means extending downwardly from said polishing elements and received by said radial grooves in said body;

a plurality of dome-shaped polishing surfaces mounted on said polishing elements and forming the working surface of said polishing elements, each of said dome-shaped polishing surfaces being convexly curved in a first direction to form in combination with the remaining polishing surfaces on said polishing elements a first lens contact surface having a constant arc of radial curvature, and each of said dome-shaped polishing surfaces being convexly curved in a second direction to form in combination with the remaining polishing surfaces on said polishing elements a second lens contact surface having a constant arc of radial curvature, whereby when said lap grinds, polishes or fines a lens, said first lens contact surface forms the base curve on the lens and said second lens contact surface forms the cross curve on the lens;

said mounting means being radially adjustable along said grooves; and locking means for securing said polishing elements at selected radial positions in said grooves.

* * * * *